US005750322A

United States Patent [19]

McGuckin et al.

[11] Patent Number: 5,750,322

[45] Date of Patent: May 12, 1998

[54] PROCESSING SILVER HALIDE FILMS WITH AN AQUEOUS PHOSPHOLIPID RINSE SOLUTION

[75] Inventors: Hugh G. McGuckin; John S. Badger, both of Rochester; Edward A. Kurz, Webster, all of N.Y.

[73] Assignee: Eastman Kodak Company, Rochester, N.Y.

[21] Appl. No.: 825,851

[22] Filed: Apr. 4, 1997

Related U.S. Application Data

[63] Continuation-in-part of Ser. No. 632,985, Apr. 16, 1996, Pat. No. 5,667,948.

[51] Int. Cl.[6] ..... G03C 5/39

[52] U.S. Cl. ..... 430/463; 430/372; 430/428; 430/429

[58] Field of Search ..... 430/372, 428, 430/429, 463

[56] References Cited

U.S. PATENT DOCUMENTS

| | | | |
|---|---|---|---|
| 3,369,896 | 2/1968 | Seemann et al. | 430/463 |
| 4,209,449 | 6/1980 | Mayhew et al. | 260/403 |
| 4,336,385 | 6/1982 | Mayhew et al. | 548/112 |
| 4,503,002 | 3/1985 | Mayhew et al. | 260/945 |
| 4,603,124 | 7/1986 | Takei et al. | 514/78 |
| 4,833,061 | 5/1989 | Tirrell | 430/138 |
| 5,286,719 | 2/1994 | Fost et al. | 514/114 |
| 5,405,983 | 4/1995 | Fost et al. | 556/405 |
| 5,529,890 | 6/1996 | McGuckin et al. | 430/429 |
| 5,667,948 | 9/1997 | McGuckin et al. | 430/463 |

OTHER PUBLICATIONS

Mona Industries Technical Bulleting No. 1019a, Jan. 1993.

Mona Indistries Technical Bulletin No. 1057, May 1994.

Fost, "Cosmetics & Toiletries Manufacture Worldwide", 1994, pp. 83–88.

*Primary Examiner*—Hoa Van Le

*Attorney, Agent, or Firm*—J. Lanny Tucker

[57] ABSTRACT

Various photographic films, that have already been photographically processed, can be cleaned or washed using an aqueous wash solution comprising a phospholipid in an amount of at least 50 ppm, to remove dust, dirt, or oily fingerprints. This solution can be particularly useful for rewashing color motion picture films.

16 Claims, No Drawings

PROCESSING SILVER HALIDE FILMS WITH AN AQUEOUS PHOSPHOLIPID RINSE SOLUTION

CROSS-REFERENCE TO RELATED APPLICATIONS

This is a continuation-in-part of recently allowed U.S. Ser. No. 08/632,985 filed Apr. 16, 1996, U.S. Pat. No. 5,667,948, PROCESSING SILVER HALIDE FILMS WITH AN AQUEOUS PHOSPHOLIPID RINSE SOLUTION, by McGuckin et al.

FIELD OF THE INVENTION

This invention relates in general to photography, and more particularly, it relates to the washing of silver halide films using a specific aqueous rinse solution.

BACKGROUND OF THE INVENTION

During the processing of photographic materials, one or more rinsing steps may be used to remove residual processing solution from the materials prior to contact with the next processing solution. Moreover, before processed materials are dried, they are generally rinsed a last time to remove all remaining chemical residues so that when they are dried, they are free of lines, water spots or scum. For example, in processing most films and papers (both color and black and white), a final rinsing or stabilizing step is used prior to drying. This is the case for motion picture films as well. In fact, because of the stringent processing conditions and requirements, motion picture films may require several washings prior to drying.

Many different formulations have been proposed for use as rinse solutions in photographic processes. Generally, they include one or more surfactants that facilitate the "cleaning" of the photographic material and uniform liquid drainage. Some final processing solutions also contain dye image stabilizers and are thusly known as stabilizing solutions. In addition, rinse or stabilizing solutions can contain one or more biocides to prevent unwanted biological growth in the processing tank or on the photographic material. The solutions may additionally contain calcium ion sequestering agents or polymers such as polyvinyl alcohol to reduce precipitation of sulfur or sulfides.

To meet all of the needs of a rinse solution, especially a final rinse solution, a careful formulation of components, generally surfactants and biocides, must be made. Proper balancing is required to keep costs low, minimize foaming and biological growth, while achieving the desired drainage and defect free processing expected by highly critical customers.

Not every rinse solution useful for processing one type of photographic element may be useful for processing other types of elements. Each type of photographic element may have surface characteristics, or be processed using unique chemicals that require unique rinse solution components. In addition, there is generally a desire to inhibit biocidal growth in such rinse solutions and on the processed elements themselves. This usually requires the presence of a biocide in addition to surfactants necessary for residue removal.

A conventional final rinse solution for processing color motion picture films includes a nonionic surfactant such as tridecylpolyethyleneoxide (12) alcohol, commercially available as RENEX 30 from ICI Surfactants. It has been observed, however, that such solutions exhibit a continual problem with biological growth, requiring frequent changes in solution and cleaning of the processing tanks. In addition, antimicrobial agents may be added, but such compounds must be handled carefully because of potential eye and skin irritation.

There are also instances in which already processed photographic films need to be washed again before further use. Normal handling of photographically processed films often results in the accumulation of dust or other debris, and oily fingerprints on film surfaces. In many cases, washing the films to eliminate this objectionable soiling is needed before they can be reused or projected (such as the case with motion picture or reversal films). Water and conventional rinse solutions may be used, but there is a concern that such wash solutions may also accumulate biogrowth and require frequent disposal.

Thus, there is a continued need in the art for means to wash already processed photographic films with a low cost, effective and non-irritating photographic wash solution that achieves all of the desired results with minimal chemicals.

SUMMARY OF THE INVENTION

The present invention provides an advance in washing already processed silver halide films by providing a processing method comprising washing an imagewise exposed and photographically processed silver halide photographic film with an aqueous wash solution comprising at least about 50 ppm of a phospholipid.

The method of this invention represents an improvement in the art because the phospholipids exhibit surface tensions low enough to provide excellent rinsing and washing capability, but additionally act as antimicrobial agents to minimize biogrowth. Thus, the phospholipids included in the aqueous wash solution act both as biocides as well as surfactants. While traditional surfactants can be added to the wash solution, they are optional. Thus, by using this invention, drying spots, lines, dust, fingerprints, chemical residues or scum on the already processed films are considerably reduced. Moreover, the wash solution is environmentally safe and considerably milder to human eyes and skin.

It is particularly advantageous that this invention is used to wash photographic films that have been processed some time before, and that need to be cleaned or rewashed in the noted aqueous solution that swells the emulsion layers, and lightly scrubs the film surfaces to remove embedded dust, dirt, and oily fingerprints. While being cleaned with the washing solution, the film surfaces may also be lightly contacted or scrubbed with a soft material such as a pad or cloth.

DETAILED DESCRIPTION OF THE INVENTION

The wash solutions of this invention are aqueous solutions generally having a pH of from about 4 to about 10. Preferably, the pH is from about 5 to about 9, and more preferably, it is from about 6.5 to about 8.5.

The wash solution can be packaged and transported as a working strength solution, or as a concentrate. It can be used as a replenisher as well as the initial wash tank working solution.

The only essential component of the wash solution is a phospholipid or mixture thereof. Phospholipids are also known to be lipids that contain phosphoric acid, and are also known as phosphoglycerides (or glycerol phosphatides) when derived from alcohols, or glycophosphoglycerides (when derived from sugars). The phospholipids useful in the practice of this invention can be synthetically prepared or obtained from nature.

One or more phospholipids are present in the wash solution in a total amount of at least about 50 ppm (by weight), and preferably in a total amount of at least about 100 ppm. More preferably, the amount is from about 100 to about 600 ppm.

In preferred embodiments, the phospholipids useful herein are represented by the structure I:

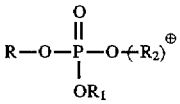

wherein R is hydrogen, a monovalent cation (such as an alkali metal ion, ammonium ion or other quaternary organic ion), or $R_2$ (defined below). Preferably, R is hydrogen or $R_2$, and more preferably R is $R_2$.

Moreover, $R_1$ is hydrogen, a monovalent cation (as defined above), or $R_2$ (defined below).

In a preferred embodiment, $R_1$ is hydrogen, a monovalent cation, or $R_2$ (defined below). More preferably, $R_1$ is the same as $R_2$.

$R_2$ is $—CH_2CH_2R_3$ or $—CH_2CHOHCH_2R_3$ wherein $R_3$ is a tertiary amine group having three substituents that can be alkyl, phenyl, cycloalkyl, heterocyclic rings or other suitable monovalent groups that would be readily apparent to one skilled in the art.

A particularly $R_3$ group is represented by the structure II:

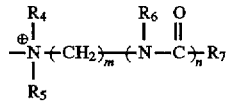

wherein each of $R_4$, $R_5$, $R_6$ and $R_7$ is substituted or unsubstituted alkyl of 1 to 20 carbon atoms (such as methyl, ethyl, hydroxymethyl, isopropyl, t-butyl, hexyl, benzyl and decyl), substituted or unsubstituted cycloalkyl of 5 or 6 carbon atoms in the ring (such as cyclopentyl, cyclohexyl and 4-methylcyclohexyl), substituted or unsubstituted alkenyl of 2 to 10 carbon atoms (such as ethylidene and 2,3-propylidene), or substituted or unsubstituted phenyl (such as p-methylphenyl, m-methoxyphenyl and phenyl), or $R_4$ and $R_5$ taken together with the nitrogen atom to which they are bonded, represent an N-heterocycle having 5 to 7 atoms in the ring (such as pyridyl). Moreover, m is an integer of 0 to 20, and n is 0 or 1, provided that when n is 1, m is at least 1.

In some preferred embodiments, in reference to structure II, each of $R_4$, $R_5$ and $R_6$ is substituted or unsubstituted alkyl or 1 or 2 carbon atoms, $R_7$ is substituted or unsubstituted alkyl of 1 to 20 carbon atoms, m is 2 to 10, and n is 1.

In still other more preferred embodiments, $R_2$ is $—CH_2CHOHCH_2R_3$, each of $R_4$, $R_5$ and $R_6$ is an alkali metal ion or a substituted or unsubstituted alkyl of 1 or 2 carbon atoms, $R_7$ is substituted or unsubstituted alkyl of 1 to 20 carbon atoms, m is 2 to 20, and n is 1.

A wide variety of phospholipids are within the scope of the noted definitions. Representative compounds are described, for example in U.S. Pat. No. 4,356,256 (O'Brien et al), U.S. Pat. No. 4,752,572 (Sundberg et al), U.S. Pat. No. 4,503,002 (Mayhew et al) and U.S. Pat. No. 5,286,719 (Fost et al), all of which are incorporated herein by reference for the description of various phospholipids and preparatory methods only. Useful phospholipids can be isolated from nature, or synthetically prepared using conventional procedures as described, for example in the noted Mayhew et al and Fost et al patents.

Since the phospholipid molecule has one or more positive charges, counterions are usually present to form salts in solution. Useful negatively charged counterions include, but are not limited to, halides (such as chloride and bromide ions), p-toluenesulfonic acid, sulfate, tetrafluoroborate and others known in the art.

Particularly useful phospholipids include cocamidopropyl phosphatidyl glycerol, linoleamidopropyl phosphatidyl glycerol and cocophosphatidyl glycerol. These materials are commercially available from MONA Industries, Inc. (Paterson, N.J.) under formulations marketed as PHOSPHOLIPID PTC, PHOSPHOLIPID EFA and PHOSPHOLIPID CDM, respectively. The first compound is most preferred.

While not essential, one or more nonionic or anionic surfactants can be included in the wash solutions useful in the practice of this invention. Mixtures of either or both types of surfactants can be included also. Thus, two or more anionic surfactants, two or more nonionic surfactants, or one or more of each type of surfactant, can be included in the wash solutions. Nonionic surfactants refer to surfactants which are not ionized in an aqueous medium, and anionic surfactants refer to surfactants having a net negative charge in an aqueous medium.

Particularly useful subclasses of nonionic surfactants include, but are not limited to, polyethoxylated surfactants (especially hydrocarbon polyethoxylated and polyethoxylated silicon surfactants), aliphatic acids, polyhydric alcohols, fluorosurfactants..

Particularly useful nonionic hydrocarbon polyethoxylated surfactants have the general formula (IV):

$$R_{10}—(B)x—(E)_m—D$$

wherein $R_{10}$ is a substituted or unsubstituted alkyl group having 8 to 20 carbon atoms, B is a substituted or unsubstituted phenyl group, x is 0 or 1, E is $—(OCH_2CH_2)—$, m is an integer of 6 to 20, and D is hydroxy or methoxy. Examples of surfactants within this formula include octylphenoxypoly(ethyleneoxide)(9) ethanol (available from Union Carbide Co. under the tradename TRITON X-100), octylphenoxypolyethylene-oxide(12) ethanol (available from Union Carbide Co. under the tradename TRITON X-102), octylphenoxy-polyethyleneoxide(30-40) ethanol (available from Union Carbide Co. under the tradename TRITON X-405), alkyl(C12-15 mixture) polyethyleneoxide(7) alcohol (available from Shell Chemical Co. under the tradename NEODOL 25-7), and tridecylpolyethyleneoxide(12) alcohol (available from ICI Americas, Inc., under the tradename RENEX 30).

Other useful nonionic surfactants include, but are not limited to, polyalkyleneoxide modified polydimethylsiloxane (available from Union Carbide Co. under the tradename SILWET L-7607), poly(ethylene oxide) fluoroalkylalcohol (available from DuPont Co. under the tradename ZONYL FSO), poly(ethylene oxide)-poly(propylene oxide) and poly (ethylene oxide) di-ol compound (available from BASF Corp. under the tradename PLURONIC L-44), and nonylphenoxy poly[hydroxy propylene oxide(8-10)] (available from Olin Corp. under the tradename SURFACTANT 10G).

Useful polysiloxane surfactants are well known compounds having a structure comprising a repeating —O—Si—O— moiety. Particularly useful compounds are polyalkoxylated dimethylpolysiloxanes, especially those described in Research Disclosure, publication 17431, October 1978, incorporated herein by reference. Most preferred compounds include polyalkoxylated dimethylpolysiloxanes which contain both ethyleneoxy and propyleneoxy groups in their structure. Some of such compounds are commercially available from Union Carbide Corporation under the trademark SILWET.

Various nonionic surfactants, including siloxane compounds, are also described in U.S. Pat. No. 5,104,775 (Abe et al), U.S. Pat. No. 5,360,700 (Kawamura et al), Japanese Kokai 63-244,036 (published Oct. 11, 1988), WO 91/05289 (published Apr. 18, 1991), and Japanese Kokai 4-025835 (published Jan. 29, 1992), all incorporated herein by reference with respect to the nonionic surfactants.

Preferred nonionic surfactants include NEODOL 25-7 and TRITON X-102 nonionic surfactants, both identified above.

Useful subclasses of anionic surfactants include, but are not limited to, sulfates or sulfonates, phosphates, carboxylates, taurates and others known in the art.

In one embodiment, preferred sulfate or sulfonate surfactants have the general formula (V):

$$R_{11}—(A)—C$$

wherein $R_{11}$ is a substituted or unsubstituted alkyl having 8 to 20 carbon atoms (preferably 10–16 carbon atoms), A is a substituted or unsubstituted aryl, or a hydroxy ethylene group, and C is $—SO_3—M^+$ or $—SO_4—M^+$ wherein $M^+$ is an alkali metal or ammonium cation.

More preferably, A is a substituted or unsubstituted aryl group (such as phenylene, xylylene or naphthylene) with phenylene being most preferred. Thus, an alkylbenzenesulfonate is a preferred subclass of the compounds of formula (V). Representative surfactants of this formula are sodium dodecylbenzenesulfonate (available from Rhone-Poulenc under the tradename SIPONATE DS-10), sodium 2-hydroxy-tetra, hexadecane-1-sulfonate (available from Witco under the tradename WITCONATE AOS), and sodium nonylphonoxypolyethoxy sulfate (available from Witco under the tradename WITCOLATE D51-51).

In another embodiment, the anionic sulfate or sulfonate surfactant can have the general formula (VI):

$$(R_{12})_n—(B)_x—(E)_y—C$$

wherein $R_{12}$ is a substituted or unsubstituted alkyl having 4 to 20 carbon atoms (more preferably 4 to 16 carbon atoms), x is 0 or 1, n is 1 when x is 0, and n is 1, 2 or 3 when x is 1, y is an integer of 1 to 8, and B, C and E are defined above.

Useful compounds of this type include alkylphenoxypolyethoxysulfates and alkylpolyethoxysulfates. More specifically, it is preferred that the compound be aromatic when x is 1. Representative compounds are sodium tributylphenoxypolyethoxysulfate (available from Hoechst Celanese under the tradename HOSTAPAL BV), sodium alkyl(C9-12)polyethyleneoxide(7)ethanesulfonate (available from PPG under the tradename AVANEL S-70), and sodium alkyl(C12-15)polyethoxy(3)sulfate (available from Witco under the tradename WITCOLATE SE-5).

WITCOLATE D51-51 anionic surfactant (identified above) is most preferred.

Various anionic surfactants are also described in U.S. Pat. No. 5,360,700 (noted above) and recently allowed U.S. Ser. No. 08/336,431 (filed Nov. 9, 1994), now U.S. Pat. No. 5,534,396 (McGuckin et al) all incorporated herein by reference with respect to the anionic surfactants.

Other examples of both nonionic and anionic surfactants that are available commercially are described by tradename and commercial source in McCutcheon's Volume 1: Emulsifiers & Detergents, 1993 North American Edition, McCutcheon Division, MC Publishing Co., Glen Rock, N.J.

When one or more surfactants are included in the wash solution of this invention, the total amount is at least about 0.01 g/l, and preferably from about 0.025 to about 1 g/l. When two or more surfactants are included, preferably, at least one is nonionic and at least one other is anionic. The weight ratio of the two types of surfactants can vary widely, but preferably, the weight ratio is from about 1:10 to about 10:1 (nonionic to anionic). More preferably, the weight ratio is from about 2:1 to about 1:2, with a 1:1 weight ratio being most preferred.

While not necessary, other addenda can be included in the wash solution if desired, including but not limited to, conventional biocides (such as isothiazolones, halogenated phenolic compounds disulfide compounds and sulfamine agents), dye image stabilizers (such as hexamethylenetetraamine), water-soluble polymers (such as polyvinyl alcohol and polyvinyl pyrrolidones), water-soluble metal chelating agents (such as hydrolyzed polymaleic anhydride polymers, inorganic and organic phosphoric acids and aminopolycarboxylic acids), defoaming agents, a source of cupric ion (such as cupric nitrate), buffers and other materials readily apparent to one skilled in the photographic art.

Preferably, however, the wash solution useful in the practice of this invention consists essentially of the one or more phospholipids as described above, and one or more surfactants as described above. More preferably, the wash solution consists of only the one or more phospholipids as described above.

The components of the wash solution described herein can be mixed together in any suitable order as would be known in the art, and stored indefinitely or used immediately. The solution can also be concentrated for storage and transportation, then diluted with water or a suitable buffer prior to use.

Unlike the method described in U.S. Ser. No. 08/632,985 (noted above), the wash solution is not used in the final processing step (after washing or stabilizing) and prior to drying, of photographic processing methods. Rather, the wash solution is used to clean already photographically processed photographic films. Moreover, it can be used one or more times to wash the same already photographically processed photographic film. Washing is generally carried out at a minimum transport speed of about 1.5 m/min in a continuous operation, or for up to about 20 seconds in a manual or mechanical operation, at a temperature of from about 15° to about 49° C.

The present invention can therefore be used to wash already photographically processed films, including color or black and white, negative (Process C-41) or reversal films (Process E-6 or Process K-1 2), or color or black and white aerial films, or color or black and white motion picture negative or print films. Preferably, it is used to wash color motion picture negative and print films using conventional Process ECN-2, Process ECP-2A and Process ECP-2B methods.

Such photographic materials and the various steps used to process them are well known and described in considerable publications, including, for example, in Research Disclosure, publication 38957, pages 625–626 (September, 1996). Research Disclosure is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011 ). This reference will be referred to hereinafter as "Research Disclosure". More details about such elements are provided herein below. The invention can be practiced with photographic films containing any of many varied types of silver halide crystal morphology, sensitizers, color couplers, and addenda known in the art, as described in the noted Research Disclosure publication and the many publications noted therein. The films can have one or more layers, at least one of which is a silver halide emulsion layer that is sensitive to electromagnetic radiation, disposed on a suitable film support (typically a polymeric material), including supports having magnetic backing or stripes.

Processing steps and solutions specific to processing color motion picture films (both negative and print) are known in the art, and are described for example in "Manual for Processing Eastman Color Films, Module 9", Kodak Technical Manual H-24.09, 1988, and "Manual for Processing Eastman Motion Picture Films, Module 7", Kodak Technical Manual H-24.07, 1990.

Washing according to the present invention can be carried out manually used a dampened cotton pad or sponge (or any other absorbent, nonabrasive material) to lightly contact or scrub the film surfaces, or mechanically using commercially available equipment, such as washing apparatus available from Technical Film System that utilizes soft brushes, pads or sprays to lightly contact and clean film surfaces.

The following examples are included for illustrative purposes only.

MATERIALS AND METHODS FOR EXAMPLE

Phospholipid formulations PHOSPHOLIPID PTC, PHOSPHOLIPID CDM and PHOSPHOLIPID EFA were obtained from Mona Industries, Inc.

Test Evaluation of PHOSPHOLIPID PTC

An aqueous solution of RENEX 30 (0.14 g/l) in water (1:1 tap water/high purity water) was incubated at 30° C. in order to obtain an inoculum of microorganisms that would provide a sufficient challenge for the antimicrobial agents being evaluated. RENEX 30 is currently used in conventional motion picture film final rinse solutions.

A sample (10 ml) of this inoculum was added to tap water (90 ml) in a sterile sample cup to form a Control solution. No antimicrobial agent was added to this Control solution. PHOSPHOLIPID PTC was added to two other solutions (Solutions A and B) at 80 and 160 ppm. Each solution was incubated at 30° C., and after three days, the microbial count in each was made using conventional Millipore Standard Plate Count (SPC) samplers and procedures [procedure: 1) dispense sample into container, 2) SPC paddle returned to container, and the unit is placed grid side down on the counter for 30 seconds, 3) the SPC paddle is removed and excess moisture shaken off, and liquid poured out, 4) paddle is replaced and unit is incubated at 30° C. allowing bacteria to thrive on the nutrient media that diffuses through the gridded membrane, and 5) the paddle is removed and the bacteria colonies enumerated]. Counts are reported as CFU/ml (colony forming units/ml) that can be defined as the estimated number of colonies of bacteria or fungi that are observed per ml of solution. The results are shown in Table I below. The initial inoculum concentration was about $1\times10^4$ CFU/ml so a 10:90 solution yielded about $1\times10^3$ CFU/ml.

TABLE I

| SOLUTION | CFU/ml |
|---|---|
| Control | $1 \times 10^5$ |
| Solution A | <10 |
| Solution B | <10 |

ADDITIONAL TEST EVALUATIONS OF PHOSPHOLIPIDS

A similar evaluation of solutions containing PHOSPHOLIPID PTC, PHOSPHOLIPID CDM and PHOSPHOLIPID EFA was carried out using more contaminated inoculum and different incubation temperatures. The microbial contamination was evaluated after 3 and 7 days using the procedure described above. The results are shown in Table II below. The initial inoculum concentration was about $2\times10^5$ CFU/ml, and a 10:90 dilution brought the concentration to about $2\times10^4$ CFU/ml.

Solution C contained PHOSPHOLIPID PTC at 160 ppm, Solution D contained PHOSPHOLIPID CDM at 160 ppm, and Solution E contained PHOSPHOLIPID EFA at 300 ppm. The Control solution contained no phospholipid.

TABLE II

| TEST TIME | SOLUTION | CFU/ml |
|---|---|---|
| 3 days, 30° C. | Control | $>1 \times 10^5$ |
| " | Solution C | <10 |
| " | Solution D | <10 |
| " | Solution E | <10 |
| 7 days, 30° C. | Control | $>1 \times 10^5$ |
| " | Solution C | <10 |
| " | Solution D | <10 |
| " | Solution E | <10 |

EXAMPLE 1

Processing of Color Motion Picture Print Film

A conventional color motion picture print film (EASTMAN ECP) was machine processed using the conventional processing solutions and conditions for Process ECP.

A wash solution containing PHOSPHOLIPID PTC at 160 ppm was utilized as the final rinse solution in the process instead of the conventional final rinse solution that contains RENEX 30. Processing was carried out for 24 days using the same final rinse solution. Solution B (identified above) was used as the final rinse replenisher solution, but the concentration in the processing tank was calculated to be about 136 ppm under steady state conditions.

Samples of the wash solution in the processing tank were evaluated for microbial contamination periodically throughout the 24 day period using the procedures described above. The tests showed that the microbial contamination never exceeded 10 CFU/ml during the entire evaluation. Moreover, the processed films during this time exhibited no residue or scum.

EXAMPLE 2

Washing of Processed Color Negative Films

This example demonstrates the use of various washing solutions to clean already processed silver halide color negative films.

Samples of imagewise exposed and photographically processed KODAK KODACOLOR GOLD PLUS Color Film (ISO 100), and ADVANTIX Color Film (ISO 200) were cut into 20 cm strips. The ADVANTIX Color Film strips comprised a magnetic backing layer. Both outer surfaces were purposely handled, leaving oily fingerprints thereon.

For each experiment, Webril 100% cotton lintless pads were wrapped around each of 2 stationary pinch rollers in a device that was modified in such a manner as to allow repeatable light pressure to be applied to both sides of the film strips as they were manually pulled through the narrow nip between the stationary pads on the rollers. Each pad was moistened on its outer surface with about 1 ml of each of the following various solutions so the solution would contact the film strips as they were pulled through the nip.

One "run" consisted of three separate passes through the nip for each washing solution. The following materials were tested in solution (distilled water) for their ability to clean fingerprinted samples of the films noted above.

Solution 1: PHOSPHOLIPID PTC (100 ppm)

Solution 2: PHOSPHOLIPID PTC (200 ppm)

Solution 3: PHOSPHOLIPID CDM (100 ppm)

Solution 4: PHOSPHOLIPID CDM (200 ppm)

Solution 5: PHOSPHOLIPID PTC (200 ppm) and WITCOLATE ES-3 anionic surfactant (0.2 g/l)

Solution 6: PHOSPHOLIPID PTC (200 ppm) and ZONYL FSO nonionic surfactant (0.025 g/l)

Solution 7: PHOSPHOLIPID PTC (200 ppm) and NEODOL 25-7 nonionic surfactant (0.2 g/l)

"Solution" 8: Control (distilled water only)

An acceptably clean film strip was one that had no perceptible fingerprints after the washing treatment. It was observed that each of Solutions 1–7 acceptably cleaned each film strip (both with and without magnetic backing layer), but the Control solution failed to acceptably clean any of the film strips.

EXAMPLE 3

Washing of Processed Motion Picture Films

The same treatment described in Example 2 was applied to samples of fingerprinted imagewise exposed and photographically processed EASTMAN 5248 Color Negative Film and EASTMAN 5388 Color Print Film. For the latter type of film, the treatment was modified to include 2 "runs" or a total of 6 passes through the washing device for each washing solution. The washing solutions described in Example 2 were used in the treatment of each type of film. Each of Solutions 1–7 provided acceptable cleaning of the films, but the Control did not.

EXAMPLE 4

Washing of Processed Color Reversal Films

This example demonstrates the practice of the present invention to clean color reversal films. The procedure described in Example 2 above was used for cleaning samples of fingerprinted imagewise exposed and photographically processed KODAK EKTACHROME ELITE II (5089) Color Reversal Film. A solution of PHOSPHOLIPID PTC (200 ppm in distilled water) was used in the treatment for 1 "run". Acceptably clean films were provided by the washing with this solution. The Control (distilled water only) failed to "clean" the films.

EXAMPLE 5

Washing of Processed Black and White Films

The procedure described in Example 4 above was used to wash samples of fingerprinted imagewise exposed and photographically processed KODAK TMAX Black and White Film (400 speed). The phospholipid solution provided acceptably "clean" films strips while the Control did not.

The invention has been described in detail with particular reference to preferred embodiments thereof, but it will be understood that variations and modifications can be effected within the spirit and scope of the invention.

We claim:

1. A photographic processing method comprising washing an already photographically processed silver halide photographic film with a wash solution comprising at least about 50 ppm of a phospholipid.

2. The method of claim 1 wherein said photographic film is a color motion picture negative or print film.

3. The method of claim 1 wherein said photographic film is a black or white, or color, negative or reversal film.

4. The method of claim 1 wherein said phospholipid is present in said wash solution in an amount of from about 100 to about 600 ppm.

5. The method of claim 1 wherein said wash solution has a pH of from about 4 to about 10.

6. The method of claim 1 wherein said wash solution comprises a mixture of phospholipids, the total concentration of phospholipids being at least about 100 ppm.

7. The method of claim 1 wherein said wash solution further comprises a nonionic or anionic surfactant in an amount of at least about 0.01 g/l.

8. The method of claim 7 wherein said wash solution further comprises two or more surfactants, and the total amount of said surfactants is at from about 0.025 to about 1 g/l.

9. The method of claim 8 wherein said wash solution comprises at least one nonionic surfactant and at least one anionic surfactant.

10. The method of claim 1 wherein said phospholipid is represented by the structure I:

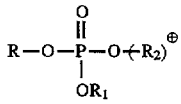

wherein

R is hydrogen, a monovalent cation, or $R_2$, $R_1$ is hydrogen, a monovalent cation, or $R_2$, and $R_2$ is $—CH_2CH_2R_3$ or $—CH_2CHOHCH_2R_3$ wherein $R_3$ is a tertiary amine group.

11. The method of claim 10 wherein each of R and $R_1$ is $R_2$, and $R_2$ is $—CH_2CH_2R_3$ or $—CH_2CHOHCH_2R_3$ wherein $R_3$ is a tertiary amine group.

12. The method of claim 10 wherein said $R_3$ is a tertiary amine group of the structure II:

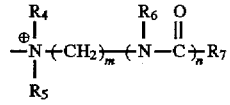

wherein each of $R_4$, $R_5$, $R_6$ and $R_7$ is alkyl of 1 to 20 carbon atoms, cycloalkyl of 5 or 6 carbon atoms in the ring or phenyl, alkenyl of 2 to 10 carbon atoms, or $R_4$ and $R_5$ taken together with the nitrogen atom to which they are bonded, represent an N-heterocycle having 5 to 7 atoms in the ring, m is an integer of 0 to 20, and n is 0 or 1, provided that when n is 1, m is at least 1.

13. The method of claim 12 wherein each of $R_4$, $R_5$ and $R_6$ is alkyl or 1 or 2 carbon atoms, $R_7$ is alkyl of 1 to 20 carbon atoms, m is 2 to 20, and n is 1.

14. The method of claim 12 wherein $R_2$ is $—CH_2CHOHCH_2R_3$, each of $R_4$, $R_5$ and $R_6$ is an alkali metal ion or an alkyl or 1 or 2 carbon atoms, $R_7$ is alkyl of 1 to 20 carbon atoms, m is 2 to 20, and n is 1.

15. The method of claim 1 wherein said phospholipid is cocamidopropyl phosphatidyl glycerol, linoleamidopropyl phosphatidyl glycerol or cocophosphatidyl glycerol.

16. The method of claim 1 wherein said washing is carried out for up to 20 seconds at a temperature of from about 15° to about 49° C.

* * * * *